United States Patent [19]

Tallier et al.

[11] Patent Number: 5,000,197

[45] Date of Patent: Mar. 19, 1991

[54] AUTOMATIC CONTROL FOR FEEDING TOBACCO TO A MACHINE

[75] Inventors: Bernard Tallier, Gorgier; Michael Lauenstein, Cormondrèche, both of Switzerland

[73] Assignee: Fabriques de Tabac Reunies, S.A., Neuchatel, Switzerland

[21] Appl. No.: 496,783

[22] Filed: Mar. 21, 1990

[30] Foreign Application Priority Data

Mar. 22, 1989 [CH] Switzerland ..... 1068/89

[51] Int. Cl.[5] ..... A24C 5/00; A24C 5/02

[52] U.S. Cl. ..... 131/108; 131/109.1; 131/109.2; 131/84.1; 131/84.3; 131/909

[58] Field of Search ..... 131/909, 108, 109.1, 131/109.2, 84.3, 84.1

[56] References Cited

FOREIGN PATENT DOCUMENTS 2088693 6/1982 United Kingdom ..... 131/108

*Primary Examiner*—V. Millin

*Attorney, Agent, or Firm*—Jeffery H. Ingerman

[57] ABSTRACT

A pressure sensor (P) and a time-measurement component actuate a gate (15) for clearing out a duct (7) as a function of a predetermined program. When the gate is open, the feed of the machine is interrrupted. When the gate is closed, suction air carries along tobacco particles from a bed (5), and negative pressure having a critical threshold exists at the level of the sensor. If, when the gate is closed, a plug of tobacco forms in the bottom opening of a sleeve (23), this sleeve is drawn upward by suction and butts against bolts (19), which dislodges the plug of tobacco. If the pressure continues to drop, the gate is opened, the sleeve falls back, and the plug is definitely dispelled.

8 Claims, 3 Drawing Sheets

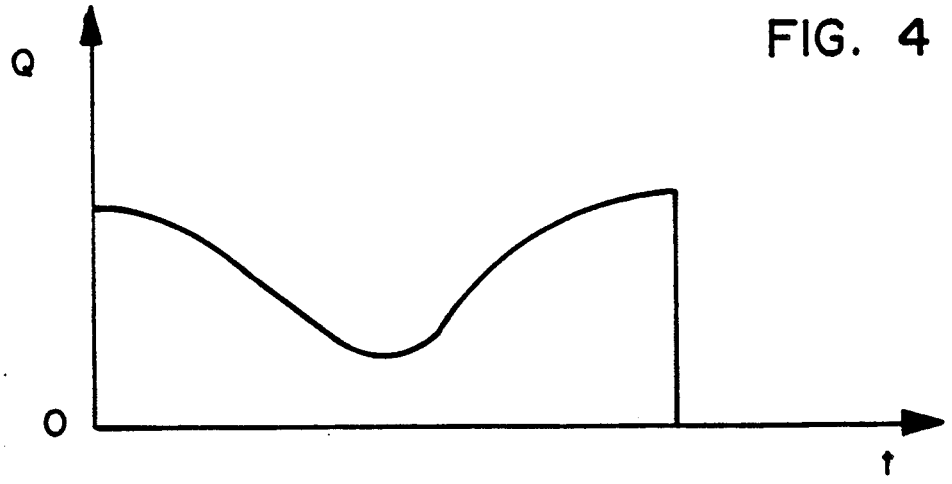
FIG. 4
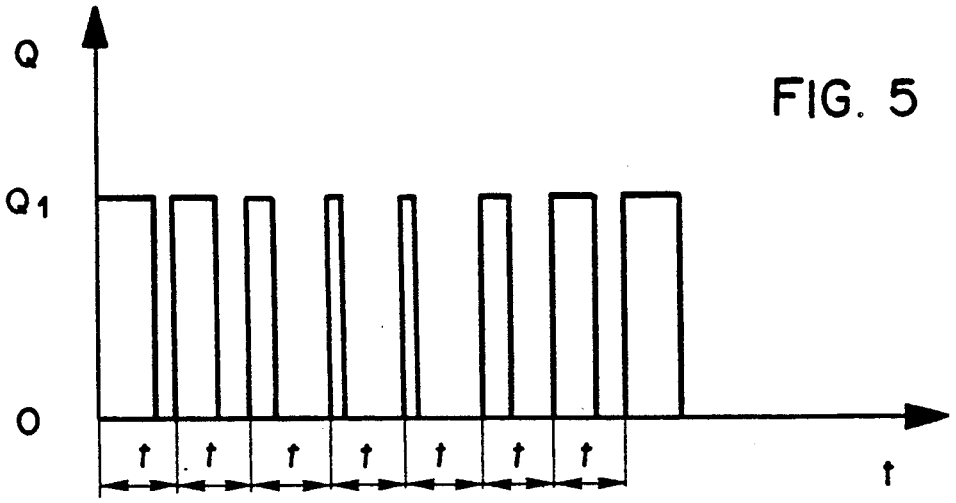
FIG. 5
FIG. 6
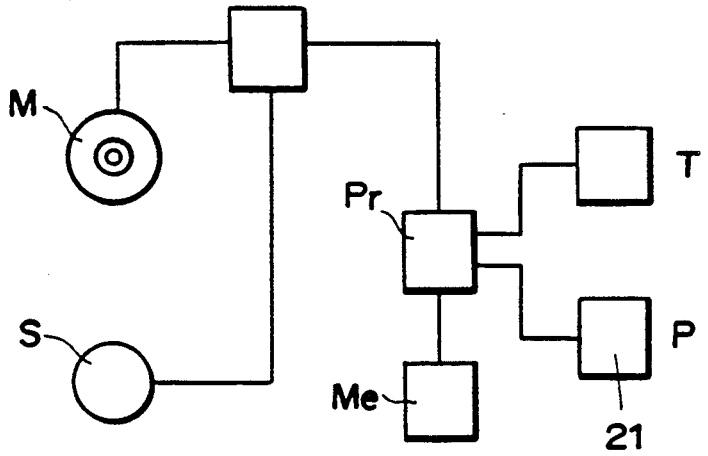

AUTOMATIC CONTROL FOR FEEDING TOBACCO TO A MACHINE

This invention relates to feed controls, and more particularly to a device for controlling the rate of flow of tobacco particles intended to feed a machine, of the type comprising a fixed duct having rigid walls, with an intake opening at one end situated opposite a bed of tobacco, and suction means for circulating within the duct a flow of air capable of conveying the flow of tobacco particles from the intake opening toward the machine.

The control of the feed to machines which treat or carry out operations on tobacco particles is a technique which it is sought to automate to the greatest extent possible but which must be capable of reacting to unforeseen or abnormal phenomena that are often difficult to translate into measurable parameters.

Considering, for example, the case of feeding cigarette-making machines, provision is frequently made for the gravity flow of tobacco particles coming from supply bins and arriving at a bed of tobacco which is often agitated by a vibrator. Above this bed there are separate, rigid ducts leading to the production machines. Each of these ducts is connected to a separator at the end nearest the machine it is to feed, and the separators themselves are equipped with suction pipes which may be connected to a single fan.

Separators are devices in which the flow of tobacco particles conveyed by suction is separated from the flow of air. The tobacco particles generally drop by the force of gravity or by centrifugal force under conditions such that they are separated from the flow of air and are collected in a hopper, from which they are fed to the machine. It has already been sought to improve the design of such separators.

The flow rate of tobacco may be regulated by means disposed at the intake of each of the conduits, above the bed of tobacco. Co-pending U.S. pat. application Ser. No. 268,989, filed Nov. 9, 1988, for example, describes a simple device for achieving this object.

U.S. Pat. No. 4,587,979 likewise describes a device for feeding tobacco particles to a treatment machine. In this device, a sliding tubular section is provided at the intake of the duct conveying the flow of tobacco. The tubular section is displaced by control apparatus between a position where the tobacco is drawn in from the bed and a position where it is not drawn in. The flow is also regulated by means of gates situated in the suction duct, beyond the separator, and in the intake duct of the machine.

Another arrangement, disclosed in U.S. Pat. No. 3,544,167, also comprises a movable tubular section situated at the intake of each duct guiding the flow of tobacco and controlled as a function of the desired rate of flow. However, this tubular section is controlled for simple on-off operation, so that it does not permit controlling a flow at a rate variable at will.

It is an object of this invention to provide a very simple improved device capable of responding automatically to a programmed control.

A further object of this invention is provide a control device which, through its simplicity, not only avoids the difficulties and drawbacks of prior art devices, but also performs several functions which have heretofore required the presence of separate means.

The intended advantages of the invention are:

1. automatic unstopping of the intake opening in case a plug of tobacco forms therein;
2. lowering of the circulation velocity of the flow of air conveying the tobacco particles, thus reducing damage caused to the particles and, consequently, the proportion of dust and overall waste of material, i.e., tobacco;
3. the possibility of bringing about a reliable control capable of being programmed so as to operate automatically during a long period of time;
4. simplicity of the device.

To this end, in the device according to the present invention, of the type initially mentioned, the conduit comprises an intake section having, at one end, the intake opening and, at the other end, a branch provided with a discharge opening and with a cut-off of this opening, and the cut-off is controlled as a function of the values of one or more parameters represented by time and/or the pressure in the intake section.

A preferred embodiment of the invention will now be described in detail with reference to the accompanying drawings, in which:

FIG. 1 is a diagrammatic view of an installation for feeding cigarette machines, FIG. 2 is a diagrammatic view on a larger scale of an embodiment of the inventive device in which only the significant elements are shown, FIGS. 3, 4, and 5 are graphs illustrating the operation of the device shown in the drawing, and FIG. 6 is an electric block diagram of the various elements of the device.

Diagrammatically depicted in FIG. 1 are three cigarette-manufacturing machines 1, each fed from a separator 2. The design of these separators does not form part of the present invention and therefore need not be described in detail.

The tobacco particles come from a supply bin (not shown) and flow along a path represented diagrammatically as 3 to arrive on a flat support 4 on which there is a bed 5 agitated with a vibratory motion, the amplitude and frequency of which may be modified at will, if necessary. Opening out above bed 5, which is continuously covered with a layer of bulk tobacco particles, are three rigid ducts 6 having fixed walls, each ending in one of the separators 2. Leaving these separators 2 are respective pipes 7 which join to form a suction duct 8 ending at the suction intake of a blower 16.

Each of the rigid ducts 6 will be seen to comprise a vertical initial portion extending above bed 5. This portion is illustrated diagrammatically on a larger scale in FIG. 2, which shows the lower part of a duct 6 comprising an intake section 9. This intake section extends upward from an intake opening 10, provided with a flange 11 and disposed above bed 5, to a junction 12 from which there branches off a short discharge section 13 having a discharge opening 14 and a cut-off gate 15 which is merely indicated diagrammatically in FIG. 2. Gate 2 can be controlled by means of a motor or a jack. Normally, it is in either the open position or the closed position. It should be understood, however, that in certain modifications of the inventive device, gate 2 might be provided with a continuously variable control.

Intake opening 10 and intake section 9 of duct 6 are further equipped with a sliding sleeve 23. This sleeve comprises a section of tubing 17 open at both ends, the diameter of which is slightly less than that of duct 6 at its base. Sleeve 23 is borne by a tubular fitting 22 fixed rigidly thereto and provided with two diametrically opposed longitudinal slots 18. Fitted into slots 18 are bolts 19 integral with the wall of duct 6, slightly above intake opening 10. As shown in the drawing, sliding sleeve 23 normally rests owing to its own weight on bolts 19, the uppermost generatrices of which form upper stops on which the tops of slots 18 can lie. Sleeve 23 further includes a flange 20 at its base.

While the means for controlling gate 15 are not shown in FIG. 2, the drawing does indicate the location of a pressure sensor 21; and FIG. 6 illustrates how the electrical connections of the automatic control device are designed. Shown in FIG. 6 are a motor M for controlling gate 15, a time sensor T, a pressure sensor P, which is the sensor 21 of FIG. 2, and a motor S representing the motor driving blower 16 which draws in the air through duct 8.

The circuit diagram of the device, depicted in a highly simplified manner in FIG. 6, comprises a memory Me and a processor Pr, the whole arranged to permit the described intake and discharge units to operate according to a predetermined program ensuring an optimum feed of tobacco to the machines.

FIGS. 3–5 illustrate the conditions this program must satisfy.

FIG. 4 shows a typical curve giving the rate of flow of tobacco Q which must be furnished to the machines during a certain period of time. As will be seen, this rate can vary quite substantially.

Figure 1:
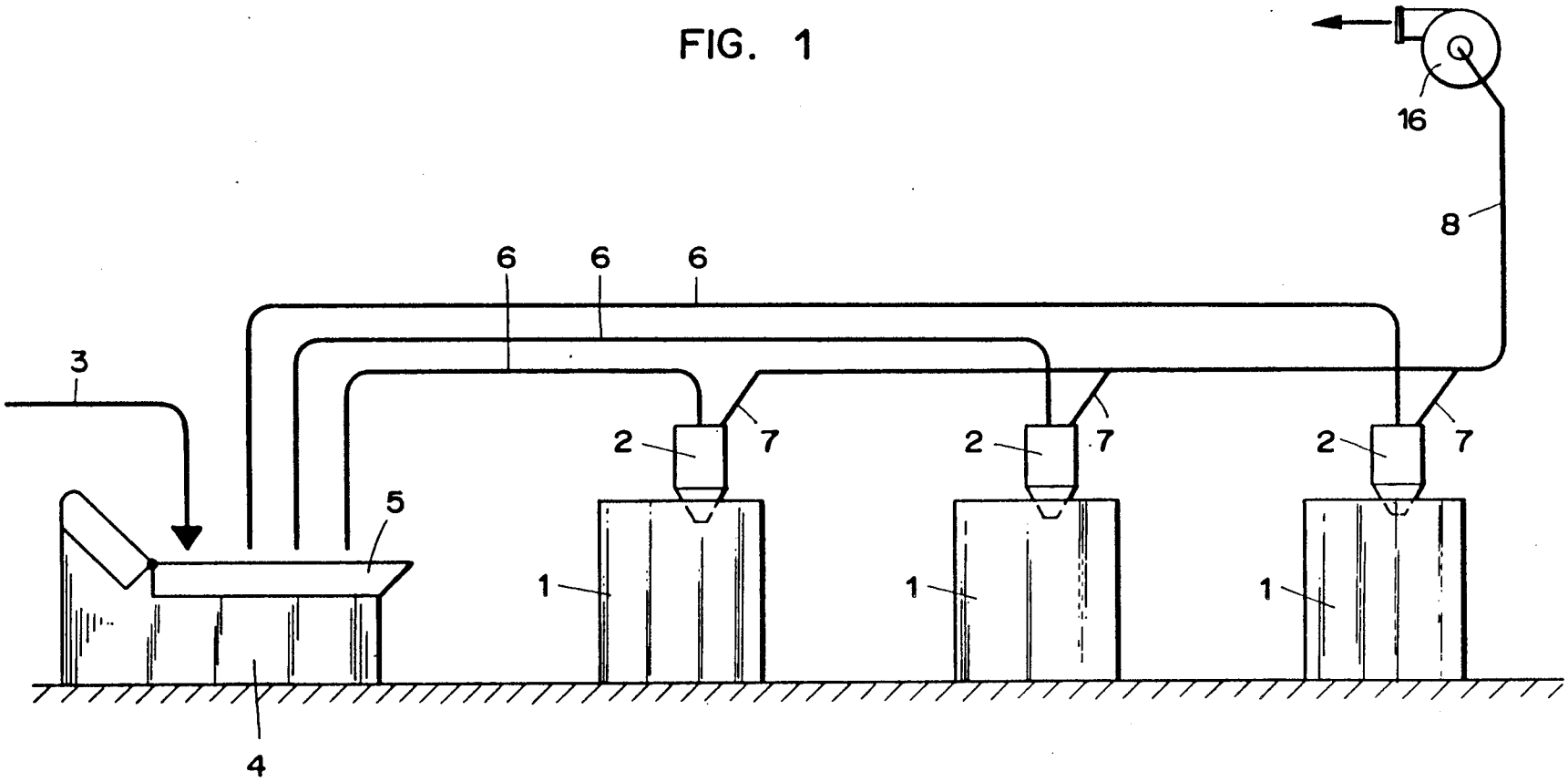

FIG. 5 shows how, in one possible program, the required rate of flow is obtained as a function of time. The blower or general compressor 16 which provides the flow of air in ducts 6 is kept operating continuously at a stable running speed, and feeding of the various machines 1 is achieved simply by manipulating gates 15 by means of motors M. It will be understood that when a gate 15 is closed, the flow of tobacco particles in the respective duct 6 is, under normal conditions, continuous and has a stable value $Q_1$ (FIG. 5). Value $Q_1$ depends upon the geometry of the installation and the power of blower 16. If, on the contrary, gate 15 is open, air is drawn in through section 13 and discharge opening 14. The pressure in section 9 rises to a value very close to the ambient pressure, and the tobacco particles are no longer drawn in. Hence it suffices to program the successive durations of feed and of flow interruption by manipulation of gate 15. According to FIG. 5, the gate is closed at fixed intervals t and opens after periods which depend upon the required rate of flow.

Figure 3:
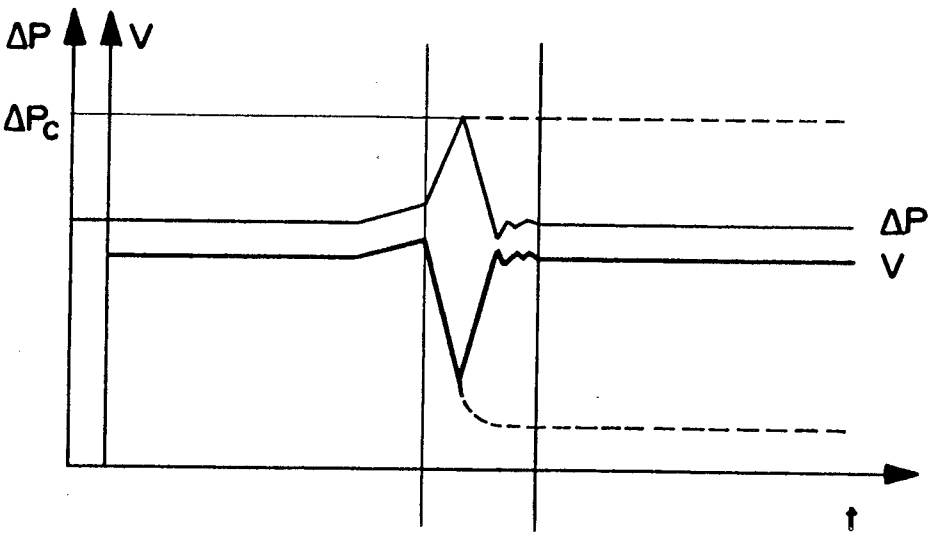

Moreover, as shown in FIG. 3, the same device can be programmed to perform a safety function and to forestall blockage of the intake openings. Installations of the type depicted in FIG. 1 present the risk that a plug of tobacco particles may form at the intake opening of duct 6, thus interrupting the feed. If such a plug forms at the lower opening of sleeve 23, the negative pressure within intake section 9, measured by pressure sensor P, increases, as may be seen from the graph in FIG. 3 showing the curve giving the negative pressure value on the y-axis and the time on the x-axis. This graph also gives the volumetric flow of tobacco V plotted on the y-axis with the time on the x-axis. When a plug forms, the negative pressure increases, and the volumetric flow decreases. This phenomenon is detected by the sensor P if it reaches a certain extent, i.e., if the negative pressure increases to a value $\Delta PC$, representing the critical negative pressure; but before that, i.e., during the phase of negative pressure increase, the assembly of sleeve 23 is drawn upward so that the lower stop represented by the lower ends of slots 18 butts against bolts 19. In most cases this jolt dislodges the plug formed, so that the negative pressure $\Delta P$ resumes its normal value without having reached the critical value $\Delta PC$.

Figure 2:
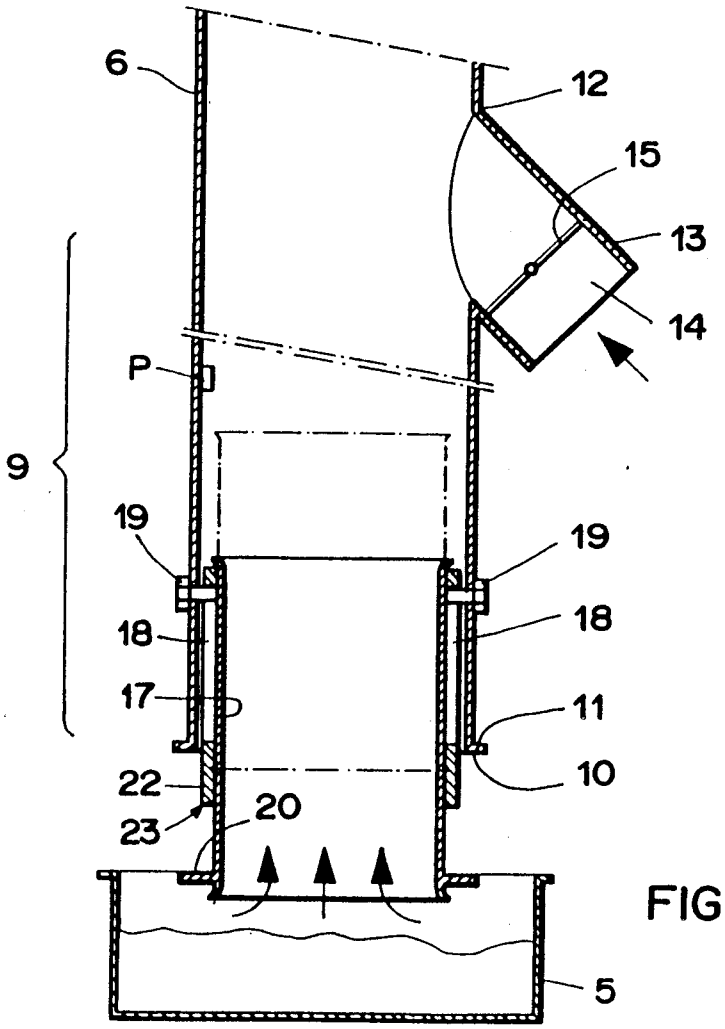

It is possible, on the other hand, that the plug may be such as not to disintegrate spontaneously when the lower stop of sleeve 23 butts against bolts 19. Detection of the critical negative pressure $\Delta PC$ then causes immediate opening of gate 15. Under these conditions, the negative pressure drops to virtually nil, and sleeve 23 falls back into its lower position as shown in FIG. 2. The upper ends of slots 18 then butt against bolts 19, and this stopping impact of sleeve 23 is certain to dislodge the plug which has formed. The program of the control device may therefore cause gate 15 to reclose a certain time $\Delta T$, e.g., two or three seconds, after that gate has opened. Operation at a normal rate of flow will then immediately resume.

It has been found that by means of this device, it is possible to achieve regular operation and a feed of tobacco as desired with a speed of circulation of the air within ducts 6 which is appreciably less than what has hitherto been necessary. Thus, in a typical case where the speed has had to be on the order of 28 m/sec until now, it has been possible to reduce that speed to within limits of 18–22 m/sec, or in a similar case, even to 16–22 m/sec.

With such operating conditions, the feed device presents less risk of damage to the tobacco particles, hence a reduction of the dust produced as well as of the energy consumed in running the blowers, while the efficiency of use of the tobacco is increased.

What is claimed is:

1. A device for controlling the rate of flow of tobacco particles fed to a machine, of the type having a fixed duct including rigid walls and an intake opening intended to be situated opposite a bed of tobacco, and suction means for circulating within said duct a flow of air capable of conveying said tobacco particles from said intake opening toward said machine, wherein the improvement comprises:

an intake section forming part of said duct, said intake opening forming part of said intake section, a discharge section branching off said intake section and including a discharge opening, gate means for blocking said discharge opening, and control means for controlling said gate means as a function of at least one of (a) time and (b) pressure in said intake section.

2. The device of claim 1, wherein said intake section is vertical, said intake opening intended to be situated above said bed of tobacco.

3. The device of claim 1, further comprising unstopping means forming part of said intake section and means for actuating said unstopping means as a function of the pressure prevailing within said intake section.

4. The device of claim 2, further comprising unstopping means forming part of said intake section and means for actuating said unstopping means as a function of the pressure prevailing within said intake section.

5. The device of claim 4, wherein said unstopping means is a rigid sleeve having two open ends and slidingly mounted within said intake section for movement between a predetermined upper position and a predetermined lower position.

6. The device of claim 5, further comprising upper stop means for determining said upper position and lower stop means for determining said lower position, the weight of said sleeve being such that upon formation of a plug of tobacco blocking said sleeve, the pressure in said intake section drops to a value capable of causing said sleeve to slide rapidly upward and to butt abruptly against said upper stop means.

7. The device of claim 6, wherein said control means include a means for causing said gate means to open abruptly after a predetermined time lag greater than the sliding time of said sleeve if the pressure in said intake means does not revert to normal after the upward sliding of said sleeve.

8. The device of claim 7, wherein said control means are programmed to cause reclosing of said gate means after a second predetermined time lag greater than the time required for said sleeve to drop back to the lower position thereof after reopening of said gate means.

* * * * *